US010634127B2

(12) United States Patent
Kang et al.

(10) Patent No.: US 10,634,127 B2
(45) Date of Patent: Apr. 28, 2020

(54) LINEAR COMPRESSOR

(71) Applicant: LG ELECTRONICS INC., Seoul (KR)

(72) Inventors: Kyoungseok Kang, Seoul (KR); Wonhyun Jung, Seoul (KR); Chulgi Roh, Seoul (KR); Sangsub Jeong, Seoul (KR); Kiwook Song, Seoul (KR); Jookon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/491,077

(22) Filed: Apr. 19, 2017

(65) Prior Publication Data

US 2017/0218931 A1 Aug. 3, 2017

Related U.S. Application Data

(62) Division of application No. 14/317,041, filed on Jun. 27, 2014.

(30) Foreign Application Priority Data

Jun. 28, 2013 (KR) ..... 10-2013-0075512
Jun. 28, 2013 (KR) ..... 10-2013-0075514
Oct. 4, 2013 (KR) ..... 10-2013-0118464

(51) Int. Cl.
*F04B 39/00* (2006.01)
*F04B 39/02* (2006.01)
*F04B 35/04* (2006.01)

(52) U.S. Cl.
CPC ..... *F04B 39/0016* (2013.01); *F04B 35/045* (2013.01); *F04B 39/0005* (2013.01);
(Continued)

(58) Field of Classification Search
CPC .. F04B 35/045; F04B 39/0016; F04B 39/005; F04B 39/0215; F04B 39/0276; F04B 39/0005; F05C 2253/12
(Continued)

(56) References Cited

U.S. PATENT DOCUMENTS 3,007,625 A 11/1961 Heinrich
3,143,281 A 8/1964 Heinrich
(Continued)

FOREIGN PATENT DOCUMENTS

CN 1480648 3/2004
CN 1508427 6/2004
(Continued)

OTHER PUBLICATIONS

Korean Office Action dated Jul. 24, 2014 issued in Application No. 10-2013-0075512.
(Continued)

*Primary Examiner* — Christopher S Bobish
(74) *Attorney, Agent, or Firm* — KED & Associates LLP

(57) ABSTRACT

A linear compressor is provided that may include a shell provided with a refrigerant inlet; a cylinder provided inside of the shell to form a compression space; a piston that reciprocates inside of the cylinder to compress a refrigerant in the compression space; and a motor assembly that provides a drive force to the piston and provided with a permanent magnet. The piston may include a piston body having a cylindrical outer circumferential surface and a surface-treated area, which may be processed with a material having a predetermined hardness value, and a valve support provided at an end of the piston body and having a suctioning hole be in communication with the compression space. The valve support may form a first non-surface-treated area, which is not surface-treated.

18 Claims, 6 Drawing Sheets

(52) U.S. Cl.
CPC ..... *F04B 39/0215* (2013.01); *F04B 39/0276* (2013.01); *F05C 2253/12* (2013.01)

(58) Field of Classification Search
USPC ..... 417/545
See application file for complete search history.

(56) References Cited

U.S. PATENT DOCUMENTS 3,813,192 A 5/1974 Adams et al.
4,027,211 A 5/1977 Omura et al.
4,035,109 A * 7/1977 Drath ..... F01L 25/063 417/403
4,516,479 A * 5/1985 Vadasz ..... F04B 15/02 417/259
4,827,163 A 5/1989 Bhate et al.
4,924,675 A 5/1990 Higham et al.
4,932,313 A * 6/1990 Gutknecht ..... F15B 15/1447 384/115
4,937,481 A 6/1990 Vitale
4,974,498 A * 12/1990 Lemelson ..... B23D 61/185 123/193.6
5,559,378 A 9/1996 Oudet et al.
5,693,991 A 12/1997 Hiterer et al.
5,704,771 A 1/1998 Fujisawa et al.
5,920,133 A * 7/1999 Penswick ..... F02G 1/043 310/15
5,941,160 A * 8/1999 Kato ..... B05C 1/02 92/155
6,097,125 A 8/2000 Park et al.
6,273,688 B1 8/2001 Kawahara et al.
6,283,012 B1 * 9/2001 Kato ..... F04B 27/0878 92/155
6,328,544 B1 * 12/2001 Kawahara ..... F04B 35/045 417/416
6,379,125 B1 4/2002 Tojo et al.
6,398,523 B1 6/2002 Hur et al.
6,413,057 B1 7/2002 Hong et al.
6,435,842 B2 8/2002 Song
6,561,144 B1 5/2003 Muraji
6,575,716 B1 * 6/2003 Morita ..... F04B 35/045 417/417
6,641,377 B2 * 11/2003 Toyama ..... F04B 35/045 417/416
6,666,662 B2 12/2003 Oh et al.
6,755,627 B2 6/2004 Chang
6,793,470 B2 9/2004 Song et al.
6,863,506 B2 3/2005 Park et al.
6,875,000 B2 4/2005 Bae et al.
6,894,407 B2 5/2005 Jung et al.
6,994,530 B2 2/2006 Fujisawa et al.
7,159,507 B2 * 1/2007 Grollimund ..... F04B 1/0408 417/492
7,288,862 B2 10/2007 Song et al.
7,331,772 B2 2/2008 Jung et al.
7,404,701 B2 7/2008 Kwon et al.
7,478,996 B2 1/2009 Kang et al.
7,537,438 B2 5/2009 Song et al.
7,614,856 B2 11/2009 Inagaki et al.
7,617,594 B2 11/2009 Hyeon
7,626,289 B2 12/2009 Her
7,649,285 B2 1/2010 Ueda
7,748,963 B2 7/2010 Lee et al.
7,748,967 B2 7/2010 Park et al.
7,775,775 B2 8/2010 Cho et al.
7,901,192 B2 3/2011 Cho et al.
7,922,463 B2 4/2011 Lee et al.
7,934,910 B2 5/2011 Park et al.
8,109,199 B2 2/2012 Kim et al.
8,109,740 B2 2/2012 Kang et al.
8,235,393 B2 * 8/2012 Esser ..... F16J 9/26 277/440
8,303,273 B2 11/2012 Kang et al.
8,556,599 B2 10/2013 Lee et al.
8,601,935 B2 * 12/2013 Giacchi ..... F04B 35/045 92/153
8,652,620 B2 * 2/2014 Fischer ..... C23C 30/00 277/442
8,747,081 B2 * 6/2014 Kang ..... F04B 35/045 310/15
8,801,409 B2 * 8/2014 Lilie ..... F04B 39/0005 417/553
9,353,773 B2 * 5/2016 Lilie ..... F04B 39/0061
2003/0147759 A1 8/2003 Chang
2004/0047750 A1 * 3/2004 Kim ..... F04B 35/045 417/417
2004/0061583 A1 4/2004 Yumita
2004/0109777 A1 6/2004 Hur et al.
2004/0145248 A1 7/2004 Jung et al.
2004/0247457 A1 12/2004 Kim et al.
2004/0258547 A1 * 12/2004 Burger ..... C23C 8/36 417/471
2005/0061143 A1 * 3/2005 Koelzer ..... F04B 27/1072 92/71
2005/0098031 A1 * 5/2005 Yoon ..... F04B 35/045 92/84
2005/0140216 A1 6/2005 Lee
2005/0142007 A1 6/2005 Lee et al.
2005/0214140 A1 9/2005 Lee et al.
2006/0024181 A1 2/2006 Kim
2006/0060196 A1 3/2006 Kim
2006/0145797 A1 7/2006 Muramatsu et al.
2006/0171825 A1 8/2006 Choi et al.
2006/0280630 A1 12/2006 Lee et al.
2007/0009370 A1 1/2007 Kim et al.
2007/0110600 A1 5/2007 Park et al.
2007/0134108 A1 6/2007 Her
2007/0166176 A1 7/2007 Kang et al.
2008/0000348 A1 * 1/2008 Schubert ..... F04B 35/045 92/153
2008/0019854 A1 * 1/2008 Haertl ..... F04B 53/14 417/545
2009/0101003 A1 4/2009 Kim et al.
2010/0021323 A1 * 1/2010 Schubert ..... F04B 35/045 417/416
2010/0046862 A1 * 2/2010 Schubert ..... F04B 35/045 384/12
2010/0242721 A1 * 9/2010 Kim ..... F04B 35/045 92/261
2010/0260627 A1 10/2010 Kang et al.
2010/0260628 A1 10/2010 Kim
2010/0260629 A1 10/2010 Kang et al.
2010/0266429 A1 10/2010 Kang et al.
2010/0290936 A1 11/2010 Kang et al.
2010/0316513 A1 12/2010 Lee et al.
2011/0056235 A1 3/2011 Hoshino et al.
2011/0194957 A1 8/2011 Kang et al.
2012/0042776 A1 * 2/2012 Gaertner ..... B60T 11/236 92/172
2013/0004343 A1 1/2013 Cho et al.
2013/0058815 A1 * 3/2013 Kim ..... F04B 35/045 417/437
2013/0195613 A1 8/2013 Kim et al.
2015/0004021 A1 * 1/2015 Kang ..... F04B 35/045 417/410.1

FOREIGN PATENT DOCUMENTS

CN 1862016 11/2006
CN 101133247 2/2008
CN 101835983 9/2010
CN 203770066 8/2014
CN 203835658 9/2014
CN 203867810 10/2014
CN 203906211 10/2014
CN 203906214 10/2014
CN 203978749 12/2014
EP 2 312 157 4/2011
JP H04-116278 4/1992
JP 05-240156 9/1993
JP 2560424 12/1996

(56) References Cited

FOREIGN PATENT DOCUMENTS

| | | |
|---|---|---|
| JP | 2000-002181 | 1/2000 |
| JP | 2000-170657 | 6/2000 |
| JP | 2001-158995 | 6/2001 |
| JP | 2001-329956 | 11/2001 |
| JP | 2002-122072 | 4/2002 |
| JP | 2002-138954 | 5/2002 |
| JP | 2004-100687 | 4/2004 |
| JP | 2006-280156 | 10/2006 |
| JP | 2007-291991 | 11/2007 |
| JP | 2008-045493 | 2/2008 |
| JP | 2008-144714 | 6/2008 |
| JP | 2010-200522 | 9/2010 |
| JP | 2013-015092 | 1/2013 |
| KR | 10-2006-0091642 | 8/2006 |
| KR | 10-2006-0091653 | 8/2006 |
| KR | 10-0792460 | 1/2008 |
| KR | 10-2010-0010421 | 2/2010 |
| KR | 10-2010-0112474 | 10/2010 |
| KR | 10-2013-0026882 | 3/2013 |
| KR | 10-2013-0118464 | 10/2013 |
| KR | 10-2013-0118580 | 10/2013 |
| KR | 10-2013-0075512 | 10/2014 |
| KR | 10-2013-0075514 | 10/2014 |
| WO | WO 02077455 | 10/2002 |
| WO | WO 2007/046608 | 4/2007 |
| WO | WO 2009-054636 | 4/2009 |
| WO | WO 2012/088571 | 7/2012 |

OTHER PUBLICATIONS

Chinese Patent Certificate dated Aug. 13, 2014 issued in Application No. 201420160887.6 (patented as CN 203770066 U).
Chinese Patent Certificate dated Sep. 17, 2014 issued in Application No. 201420187800.4 (patented as CN 203835658 U).
Korean Office Action dated Oct. 13, 2014 issued in Application No. 10-2013-0075512.
Korean Office Action dated Oct. 13, 2014 issued in Application No. 10-2013-0075514.
European Search Report dated Nov. 14, 2014 issued in Application No. 14 16 8916.6.
European Search Report dated Aug. 10, 2015 issued in Application No. 14 16 9566.8.
European Search Report dated Sep. 7, 2015 issued in Application No. 14 16 8915.8.
European Search Report dated Sep. 17, 2015 issued in Application No. 14 16 9571.8.
European Search Report dated Sep. 21, 2015 issued in Application No. 14 16 9672.6.
European Search Report dated Sep. 25, 2015 issued in Application No. 14 16 9573.4.
European Search Report dated Oct. 2, 2015 issued in Application No. 14 16 9617.9.
European Search Report dated Oct. 14, 2015 issued in Application No. 14 17 1511.0.
Chinese Office Action dated Dec. 14, 2015 issued in Application No. 201410165549.6.
Chinese Office Action dated Dec. 25, 2015 issued in Application No. 201410144045.6.
Chinese Office Action dated Dec. 28, 2015 issued in Application No. 2014101558903.
Chinese Office Action dated Dec. 28, 2015 issued in Application No. 201410136374.6.
(3) Chinese Office Actions dated Dec. 30, 2015 issued in Application Nos. 201410165679.x, 201410134056.6, and 201410155034.8.
U.S. Office Action issued in U.S. Appl. No. 14/317,172 dated May 19, 2016.
U.S. Office Action issued in U.S. Appl. No. 14/317,218 dated May 20, 2016.
U.S. Office Action issued in U.S. Appl. No. 14/317,120 dated Jun. 2, 2016.
U.S. Office Action issued in U.S. Appl. No. 14/317,217 dated Jun. 15, 2016.
United States Office Action dated Sep. 8, 2016 issued in U.S. Appl. No. 14/317,336.
United States Office Action dated Sep. 30, 2016 issued in U.S. Appl. No. 14/316,908.
Chinese Patent No. 104251196 issued Oct. 5, 2016.
United States Office Action dated Oct. 11, 2016 issued in U.S. Appl. No. 14/280,825.
European Search Report dated Oct. 12, 2016 issued in Application No. 16172236.8.
United States Final Office Action dated Oct. 17, 2016 issued in U.S. Appl. No. 14/317,218.
U.S. Office Action dated Dec. 1, 2016 issued in U.S. Appl. No. 14/317,172.
U.S. Office Action dated, Dec. 5, 2016 issued in U.S. Appl. No. 14/317,120.
U.S. Office Action dated Dec. 16, 2016 issued in U.S. Appl. No. 14/317,217.
U.S. Appl. No. 14/280,825, filed May 19, 2014.
U.S. Appl. No. 14/316,908, filed Jun. 27, 2014.
U.S. Appl. No. 14/317,217, filed Jun. 27, 2014.
U.S. Appl. No. 14/317,218, filed Jun. 27, 2014.
U.S. Appl. No. 14/317,120, filed Jun. 27, 2014.
U.S. Appl. No. 14/317,336, filed Jun. 27, 2014.
Chinese Office Action dated Mar. 3, 2017 (English Translation).
Japanese Office Action dated May 29, 2018.
Indian Office Action dated Sep. 29, 2018 issued in Application No. 674/KOL/2014.
Japanese Office Action dated Sep. 11, 2018 issued in Application No. 2014-134809.
Korean Office Action dated Jan. 21, 2020 issued in Application No. 10-2013-0118464.

* cited by examiner

LINEAR COMPRESSOR

CROSS-REFERENCE TO RELATED APPLICATION(S)

This application is a Divisional Application of prior U.S. patent application Ser. No. 14/317,041 filed Jun. 27, 2014, which claims priority under 35 U.S.C. 119 and 35 U.S.C. 365 to Korean Patent Application No. 10-2013-0075512, filed in Korea on Jun. 28, 2013, No. 10-2013-0075514, filed in Korea on Jun. 28, 2013, and No. 10-2013-0118464, filed in Korea on Oct. 4, 2013, which are hereby incorporated by reference in their entirety.

BACKGROUND

1. Field

A linear compressor is disclosed herein.

2. Background

In general, compressors may be mechanisms that receive power from power generation devices, such as electric motors or turbines, to compress air, refrigerants, or other working gases, thereby increasing a pressure of the working gas. Compressors are widely used in home appliances or industrial machineries, such as refrigerators and air-conditioners.

Compressors may be largely classified into reciprocating compressors, in which a compression space, into which and from which a working gas, such as a refrigerant, is suctioned and discharged, is defined between a piston and a cylinder to compress the refrigerant while the piston is linearly reciprocated within the cylinder; rotary compressors, in which a compression space, into and from which a working gas, such as a refrigerant is suctioned and discharged, is defined between a roller, which is eccentrically rotated, and a cylinder to compress the refrigerant while the roller is eccentrically rotated along an inner wall of the cylinder; and scroll compressors, in which a compression space, into and from which a working gas, such as a refrigerant, is suctioned and discharged, is defined between an orbiting scroll and a fixed scroll to compress the refrigerant while the orbiting scroll is rotated along the fixed scroll. In recent years, among the reciprocating compressors, linear compressors having a simple structure in which a piston is directly connected to a drive motor, which is linearly reciprocated, to improve compression efficiency without mechanical loss due to switching in moving, are being actively developed. Generally, such a linear compressor is configured to suction and compress a refrigerant while a piston is linearly reciprocated within a cylinder by a linear motor in a sealed shell, thereby discharging the compressed refrigerant.

The linear motor has a structure in which a permanent magnet is disposed between an inner stator and an outer stator. The permanent magnet may be linearly reciprocated by a mutual electromagnetic force between the permanent magnet and the inner (or outer) stator. Also, as the permanent magnet is operated in a state in which the permanent magnet is connected to the piston, the refrigerant may be suctioned and compressed while the piston is linearly reciprocated within the cylinder and then be discharged.

A linear compressor according to the related art is disclosed in Korean Patent Publication No. 10-2010-0010421. The linear compressor according to the related art may include an outer stator, an inner stator, and a permanent magnet, which form a linear motor. The permanent magnet may be connected to an end of a piston. When the permanent magnet linearly reciprocates due to a mutual electromagnetic force between the inner stator and the outer stator, the piston linearly reciprocates in a cylinder along with the permanent magnet.

According to the related art, while the piston repeatedly moves within the cylinder, interference between the cylinder and the piston may occur causing abrasion of the cylinder or piston. More particularly when a predetermined pressure (a coupling pressure) acts on the piston causing deformation of the piston due to pressure, interference between the cylinder and the piston may occur. Also, if a slight error occurs while the piston is assembled with the cylinder, a compression gas may leak to the outside, and thus, abrasion between the cylinder and the piston may occur.

As described above, interference between the cylinder and the piston may occur causing interference between the permanent magnet and the inner and outer stators, thereby damaging components. Also in a case of the related art linear compressor, each of the cylinder or the piston may be formed of a magnetic material. Thus, a large amount of flux generated in the linear motor may leak to the outside through the cylinder and piston, deteriorating efficiency in the compressor.

BRIEF DESCRIPTION OF THE DRAWINGS

Embodiments will be described in detail with reference to the following drawings in which like reference numerals refer to like elements, and wherein.

DETAILED DESCRIPTION

Figure 1:
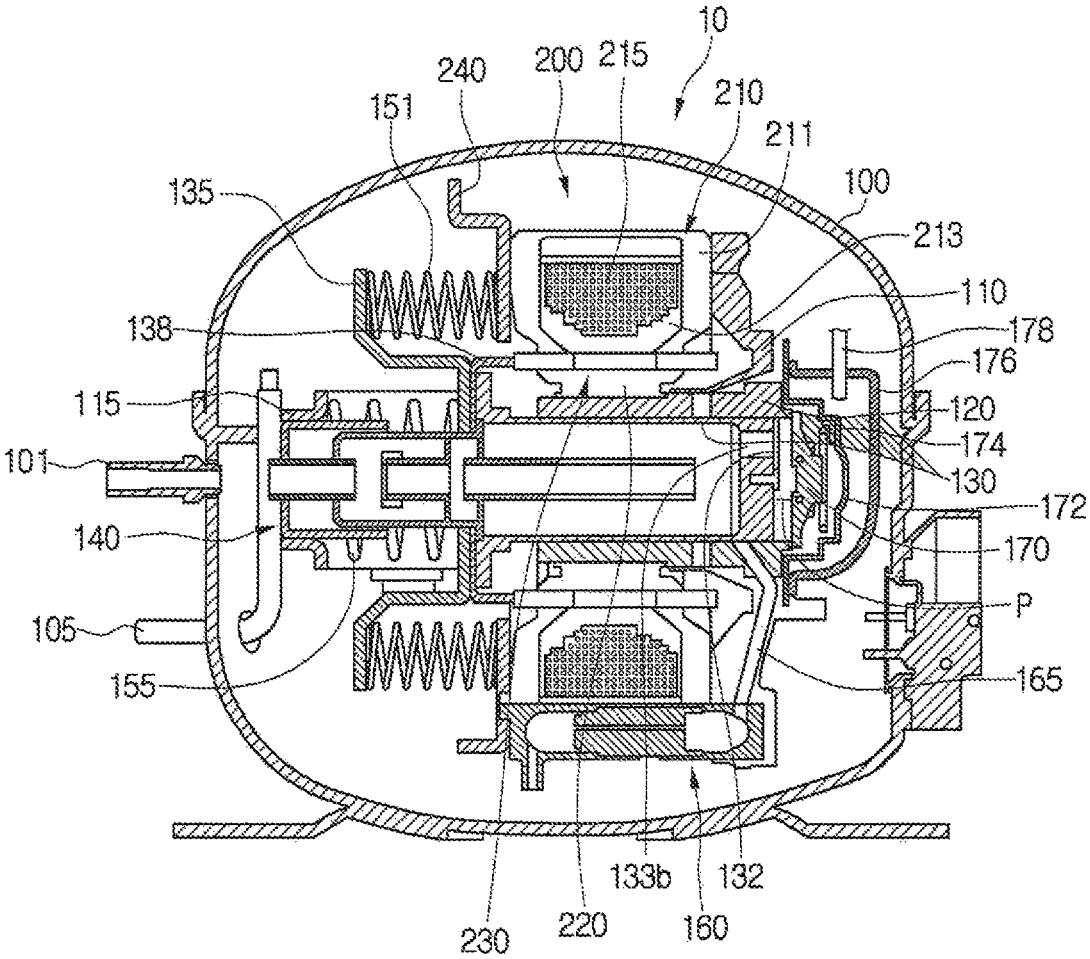
FIG. 1 is a cross-sectional view of a linear compressor according to an embodiment.

Hereinafter, embodiments will be described with reference to accompanying drawings. However, the scope is not limited to embodiments disclosed herein, and thus, a person skilled in the art, who understood the scope, would easily suggest other embodiments within the same scope thereof. Where possible, like reference numerals have been used to indicate like elements and repetitive disclosure has been omitted.

FIG. 1 is a cross-sectional view of a linear compressor according to an embodiment. Referring to FIG. 1, the linear compressor 10 may include a cylinder 120 disposed in a shell 100, a piston 130 that linearly reciprocates inside the cylinder 120, and a motor assembly 200 that exerts a drive force on the piston 130. The shell 100 may include, an upper shell and a lower shell.

The shell 100 may further include an inlet 101, through which a refrigerant may flow into the shell 100, and an outlet 105, through which the refrigerant compressed inside the cylinder 120 may be discharged from the shell 100. The refrigerant suctioned in through the inlet 101 may flow into the piston 130 via a suction muffler 140. While the refrigerant passes through the suction muffler 140, noise may be reduced.

A compression space P to compress the refrigerant by the piston 130 may be defined in the cylinder 120. A suction hole 133*b*, through which the refrigerant may be introduced into the compression space P, may be defined in the piston 130, and a suction valve 132 that selectively opens the suction hole 133*b* may be disposed at a side of the suction hole 133*b*. The suction valve 132 may be formed of a steel plate.

A discharge valve assembly 170, 172, and 174 to discharge the refrigerant compressed in the compression space P may be disposed at a side of the compression space P. That is, the compression space P may be formed between an end of the piston 130 and the discharge valve assembly 170, 172, and 174.

The discharge valve assembly 170, 172, and 174 may include a discharge cover 172, in which a discharge space of the refrigerant may be defined; a discharge valve 170, which may be opened and introduce the refrigerant into the discharge space when the pressure of the compression space P is not less than a discharge pressure; and a valve spring 174, which may be disposed between the discharge valve 170 and the discharge cover 172 to exert an elastic force in an axial direction. The term "axial direction" used herein may refer to a direction in which the piston linearly reciprocates, that is, a horizontal direction in FIG. 1.

The suction valve 132 may be disposed at a first side of the compression space P, and the discharge valve 170 may be disposed at a second side of the compression space P, that is, at an opposite side of the suction valve 132. While the piston 130 linearly reciprocates inside the cylinder 120, the suction valve 132 may be opened to allow the refrigerant to be introduced into the compression space P when the pressure of the compression space P is lower than the discharge pressure and not greater than a suction pressure. In contrast, when the pressure of the compression space P is not less than the suction pressure, the refrigerant in the compression space P may be compressed in a state in which the suction valve 132 is closed.

When the pressure of the compression space P is the discharge pressure or greater, the valve spring 174 may be deformed to open the discharge valve 170, and the refrigerant may be discharged from the compression space P into a discharge space of the discharge cover 172. The refrigerant in the discharge space may flow into a loop pipe 178 via a discharge muffler 176. The discharge muffler 176 may reduce flow noise of the compressed refrigerant, and the loop pipe 178 may guide the compressed refrigerant to the outlet 105. The loop pipe 178 may be coupled to the discharge muffler 176 and curvedly extend to be coupled to the outlet 105.

The linear compressor 10 may further include a frame 110. The frame 110, which may fix the cylinder 120 within the shell 100, may be integrally formed with the cylinder 120 or may be coupled to the cylinder 120 by means of a separate coupling member, for example. The discharge cover 172 and the discharge muffler 176 may be coupled to the frame 110.

The motor assembly 200 may include an outer stator 210, which may be fixed to the frame 110 and disposed so as to surround the cylinder 120 an inner stator 220 disposed apart from an inside of the outer stator 210, and a permanent magnet 230 disposed in a space between the outer stator 210 and the inner stator 220. The permanent magnet 230 may linearly reciprocate by a mutual electromagnetic force between the outer stator 210 and the inner stator 220. The permanent magnet 230 may include a single magnet having one pole facing the outer stator 210, or multiple magnets having three poles facing the outer stator 210. In more detail, in a magnet having three poles, when poles of a first surface are arranged in the form of N-S-N, the poles of a second surface may be arranged in the form of S-N-S. The permanent magnet 230 may be composed of a ferrite material, which is relatively inexpensive.

The permanent magnet 230 may be coupled to the piston 130 by a connection member 138. The connection member 138 may extend to the permanent magnet 230 from an end of the piston 130. As the permanent magnet 230 linearly moves, the piston 130 may linearly reciprocate in an axial direction along with the permanent magnet 230.

The outer stator 210 may include a bobbin 213, a coil 215, and a stator core 211. The coil 215 may be wound in a circumferential direction of the bobbin 211. The coil 215 may have a polygonal section, for example, a hexagonal section. The stator core 211 may be formed by stacking a plurality of laminations in a circumferential direction, and may be disposed to surround the bobbin 213 and the coil 215.

When a current is applied to the motor assembly 200, current may flow through the coil 215, a magnetic flux may be formed around the coil 215 by the current flowing through the coil 215, and the magnetic flux may flow along the outer stator 210 and the inner stator 220 while forming a closed circuit. When the magnetic flux flowing along the outer stator 210 and the inner stator 220 interacts with the magnetic flux of the permanent magnet 230, a force to move the permanent magnet 230 may be generated.

A state cover 240 may be disposed at a side of the outer stator 210. A first end of the outer stator 210 may be supported by the frame 110, and a second end of the outer stator 210 may be supported by the stator cover 240.

The inner stator 220 may be fixed to an outer circumference of the cylinder 120. The inner stator 220 may be formed by stacking a plurality of laminations at an outer side of the cylinder 120 in a circumferential direction.

The linear compressor 10 may further include a supporter 135 that supports the piston 130, and a back cover 115 that extends toward the inlet 101 from the piston 130. The back cover 115 may be disposed to cover at least a portion of the suction muffler 140.

The linear compressor 10 may include a plurality of springs 151 and 155, a natural frequency of each of which may be adjusted so as to allow the piston 130 to perform resonant motion. The plurality of springs 151 and 155 may include a plurality of first springs 151 supported between the supporter 135 and the stator cover 240, and a plurality of second springs 155 supported between the supporter 135 and the back cover 115. The plurality of first springs 151 and the plurality of second springs 155 may have a same elastic coefficient.

The plurality of first springs 151 may be provided at upper and lower sides of the cylinder 120 or piston 130, and the plurality of second springs 155 may be provided at a front, of the cylinder 120 or piston 130. The term "front" used herein may refer to a direction oriented toward the inlet 101 from the piston 130. The term "rear" may refer to a direction oriented toward the discharge valve assembly 170, 172 and 174 from the inlet 101. These terms may also be equally used in the following description.

A predetermined amount of oil may be stored on an inner bottom surface of the shell 100. An oil supply device 160 to pump oil may be provided in a lower portion of the shell 100. The oil supply device 160 may be operated by vibration generated according to the linear reciprocating motion of the piston 130 to thereby pump the oil upward.

The linear pressor 10 may further include an oil supply pipe 165 that guides the flow of the oil from the oil supply device 160. The oil supply pipe 165 may extend from the oil supply device 160 to a space between the cylinder 120 and the piston 130. The oil pumped from the oil supply device 160 may be supplied to the space between the cylinder 120 and the piston 130 via the oil supply pipe 165, and perform cooling and lubricating operations.

Figure 2:
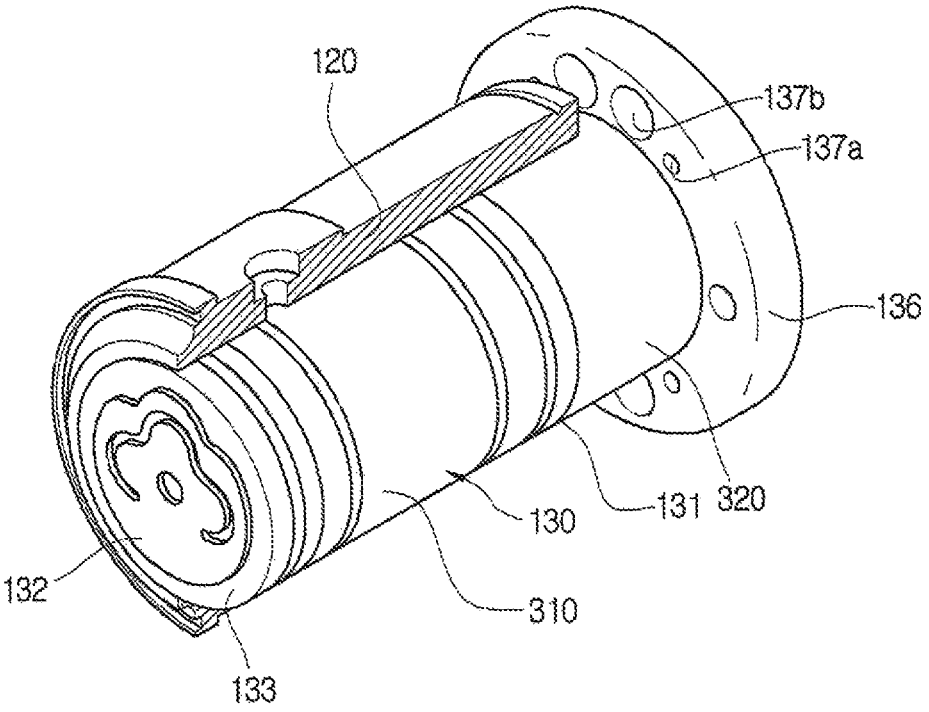
FIG. 2 is a partial cross-sectional perspective view of a coupled state between a cylinder and a piston according to an embodiment.
Figure 3:
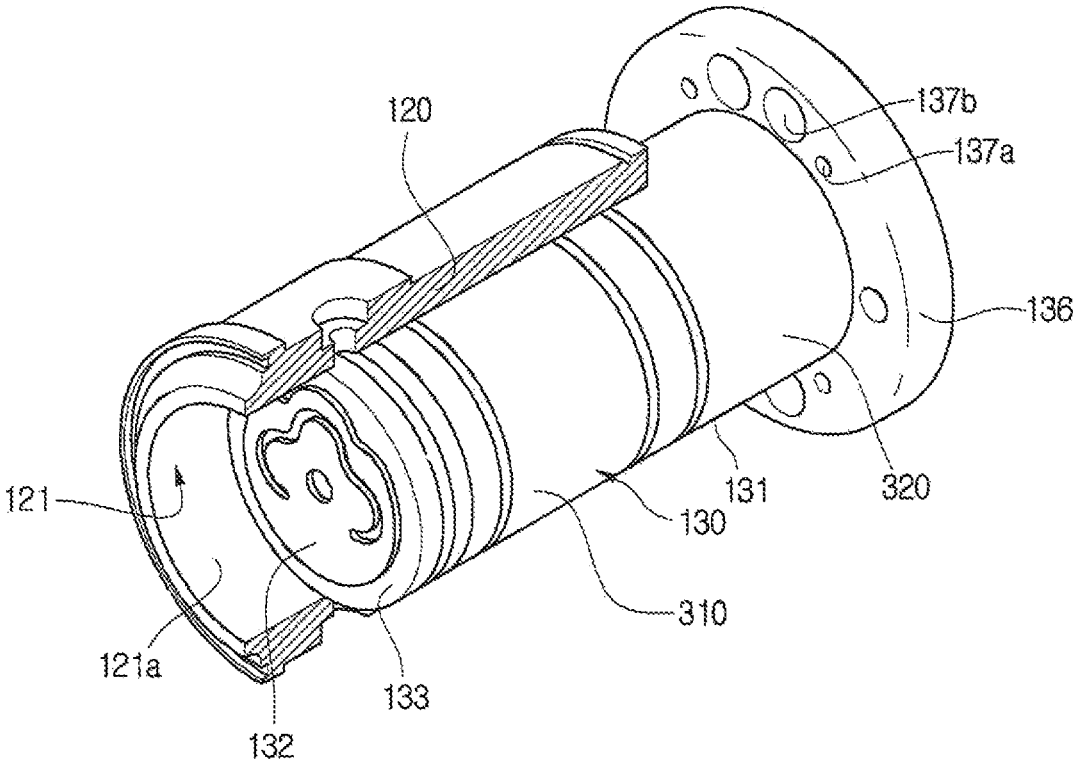
FIG. 3 is a partial cross-sectional perspective view of the cylinder and the piston of FIG. 2 illustrating movement.
Figure 4:
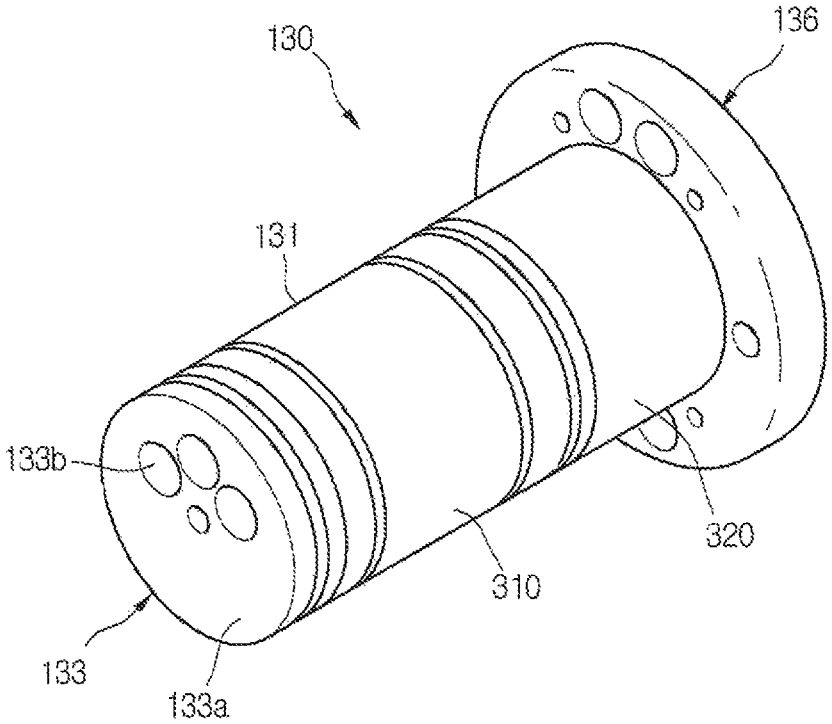
FIG. 4 is a perspective view of a piston according to an embodiment.

FIG. 2 is a partial cross-sectional perspective view of a coupled state between a cylinder and a piston according to an embodiment FIG. 3 is a partial cross-sectional perspective view of the cylinder and the piston of FIG. 2 illustrating movement. FIG. 4 is a perspective view of a piston according to an embodiment.

Referring to FIGS. 2 through 4, the piston 130 according to an embodiment is provided to reciprocate inside the cylinder 120. The piston 130 may be made of a nonmagnetic material such as an aluminum-based material, for example, aluminum or aluminum alloy. As the piston 130 may be made of the aluminum-based material, the magnetic flux generated in the motor assembly 200 may be delivered to the piston 130, thereby preventing the magnetic flux from being leaked to the outside of the piston 130. The piston 130 may be formed by forging, for example.

The piston 130 may include a piston body 131 having an approximately cylindrical shape and disposed inside the cylinder 120, and a flange 136 that extends in a radial direction from a first end of the piston body 131 and coupled to the connection member 138. The piston 130 may reciprocate along with the permanent magnet 230.

A valve support 133 that forms one or more suction holes **133*b* may be provided to a second end of the piston body 131. A refrigerant flowing in the piston body 131 may flow into the compression space P through the one or more suction hole 133*b***.

In summary, the flange 136 coupled to the permanent magnet 230 may be provided to or at the first end of the piston body 131, and the valve support 133 having a surface that faces the compression space P may be provided to or at the second end of the piston body 131. The valve support 133 may be made of a nonmagnetic material, for example, aluminum.

The suction valve 132, which may selectively open the suction hole **133*b*, may be provided to the valve support 133. When the pressure of the compression space P is less than a suction pressure, that is, the inner pressure of the piston body 131, the suction valve 132 may be opened, and when the pressure of the compression space P is larger than the suction pressure, the suction valve 132** may be closed.

The piston body 131 may include an outer circumference provided with a surface-treated portion 310 and a (first) non-surface-treated portion 320. The outer circumferential surface, on which the surface-treated portion 310 may be formed, may be referred to as a "first outer circumferential surface", and the outer circumferential surface, on which the non-surface-treated portion 320 may be formed, may be referred to as a "second outer circumferential surface".

The surface-treated portion 310 may be a portion of the outer circumferential surface of the piston body 131, which is surface-treated, and the non-surface-treated portion 320 may be an aluminum surface, which is not surface-treated. The surface-treated portion 310 may be formed to extend in a direction oriented toward the flange 136 from the second end of the piston body 130 coupled to the valve support 133. The surface-treated portion 310 may be provided to improve abrasion resistance, lubrication, or heat resistance of the piston body 131. For example, the surface-treated portion 310 may be a "first coating layer". The surface-treated portion 310 may be made of one of Teflon (PTFE), diamond like carbon (DLC), Nickel (Ni)-phosphorous (P) alloy, or an anodizing layer. The above-described materials will be described hereinbelow.

PTFE is a fluorine-based polymer and is generally referred to as "Teflon". The PTFE may be partially sprayed on the outer circumferential surface of the piston body 131 in a state in which a fluorene resin is configured to paint, is heated, and plasticized at a constant temperature to form an inert coating layer. As the PTFE has a low friction coefficient, when the PTFE is coated on the outer circumferential surface of the piston body 131, surface lubrication may be enhanced and abrasion resistance improved.

The PTFE has a relatively very low hardness, and measurement of hardness of the PTFE may be performed by the pencil hardness test. For example, the hardness of the PTFE may be the pencil hardness HB or higher. When the hardness of the PTFE is converted to a Vickers hardness (Hv), the PTFE may have a Vickers hardness in a range of approximately 0-30 Hv.

The anodizing layer may be an aluminum oxide layer, which may be formed when a current is applied to an aluminum anode, and an aluminum surface is oxidized by oxygen generated in the aluminum anode. The anodizing layer may have superior corrosion resistance and insulation resistance. The hardness of the anodizing layer may be varied with a state or component of a base material (mother material) to be coated, and may have a range of approximately 300-500 Hv.

DLC is a non-crystalline carbon-based new material, and may be provided in the form of a thin film by electrically accelerating carbon ions in plasma or activated hydrocarbon molecules and allowing the electrically accelerated carbon ions or activated hydrocarbon molecules to a surface. The DLC may have physical properties similar to diamond, that is, high hardness and abrasion resistance, superior electrical insulation, and a low friction coefficient, which leads to superior lubrication. The DLC may have a hardness in a range of approximately 1,500-1,800 Hv.

The Ni—P alloy may be coated on the outer circumferential surface of the piston body 131 by an electroless nickel plating, for example, and may be formed when Ni and P components are surface-precipitated at a uniform thickness. The Ni—P alloy may have a composition including Ni: ~90-92% and P: ~9-10%. The Ni—P alloy may improve corrosion resistance and abrasion resistance of a surface to provide superior lubrication. The Ni—P alloy may have a hardness in a range of approximately 500-600 Hv.

Aluminum materials have good heat transfer properties. However, when the surface-treated portion 310 is provided to the piston body 131 made of an aluminum material, the heat transfer property in the piston body 131 may be reduced compared to a case in which the piston body 131 is made of only the aluminum material. Therefore, while the piston 130 reciprocates inside the cylinder 120, a temperature of the inner space of the cylinder 120 may be elevated to a high temperature, the heat expansion rate in the portion, among the piston body 131, where the surface-treated portion 310 is provided may be different from that in the portion where the non-surface-treated portion 320 is provided.

The non-surface-treated portion 320 may be formed at or on only an area equal to a region extending from the first end of the piston body 131 toward the second end of the piston body 131. That is, the non-surface-treated portion 320 may be formed to extend in a direction oriented toward the valve support 133 from the flange 136. The surface-treated portion 310 may be coupled to the non-surface-treated portion 320.

The valve support 133 may include a (second) non-surface-treated portion 133*a*. The non-surface-treated portion 133*a* may be a portion which is not subject to a separate surface treatment, and may be formed of only the nonmagnetic material, for example, aluminum, forming the valve support 133. As aluminum has a superior heat transfer rate, compression heat formed in the compression space P may be easily delivered to the piston through the valve support 133.

The flange 136 may include a plurality of holes 137*a* and 137*b*. The plurality of holes 137*a* and 137*b* may include at least one coupling hole 137*a*, into which a coupling member coupled to the supporter 135 and the connection member 138 may be inserted, and at least one through hole 137*b* to reduce flow resistance generated around the piston 130.

The cylinder 120 may be made of a nonmagnetic material, such as an aluminum-based material, for example, aluminum or aluminum alloy. The cylinder 120 and the piston 130 may have a same material composition ratio, that is, type and composition ratio.

As the cylinder 120 may be made of the aluminum-based material, the magnetic flux generated in the motor assembly 200 may be delivered to the cylinder 120, thereby preventing the magnetic flux from being leaked to the outside of the cylinder 120. The cylinder 120 may be formed by extruded rod processing, for example.

The cylinder 120 and the piston 130 may have a same material composition ratio, that is, type and composition ratio. The piston 130 and the cylinder 120 may be made of a same material, for example, aluminum, and thus, may have a same thermal expansion coefficient.

The cylinder 120 may have a hollow cylindrical shape, and may movably receive the piston body 131 therein. The cylinder 120 may include an inner circumferential surface 121 that faces the outer circumferential surface of the piston body 131.

The inner circumferential surface of the cylinder 120 may include a (third) non-surface-treated portion 121*a*. The non-surface-treated portion 121*a* may be a portion which is not subject to a separate surface treatment, and may be formed of an aluminum material. For example, the non-surface-treated portion 121*a* may be made of a material corresponding to the non-surface-treated portion 133*a* of the piston 130 and the non-surface-treated portion 320, and may have a same heat expansion coefficient as the non-surface-treated portion 133*a* and the non-surface-treated portion 320.

Additional embodiments are discussed hereinbelow.

The inner circumferential surface 121 of the cylinder may include a surface-treated portion. The surface-treated portion of the inner circumferential surface 121 may be made of one of Teflon (PTFE), diamond like carbon (DLC), Nickel (Ni)-phosphorous (P) alloy, or an anodizing layer.

It is, however, noted that the surface-treated portion of the inner circumferential surface 121 may be made of a material different from the material forming the surface-treated portion 310 of the piston 130. This is because only when a hardness difference between the surface-treated portion of the inner circumferential surface 121 and the surface-treated portion of the piston 130 is not less than a predetermined hardness value, abrasion of the cylinder 120 or the piston 130 may be prevented.

For example, the surface-treated portion of the inner circumferential surface 121 may be made of an anodizing layer which does not have a relatively great influence on heat transfer rate, and the surface-treated portion 310 of the piston 130 may be made of PTFE (Teflon), which has a great influence on the heat transfer rate.

Figure 5A:
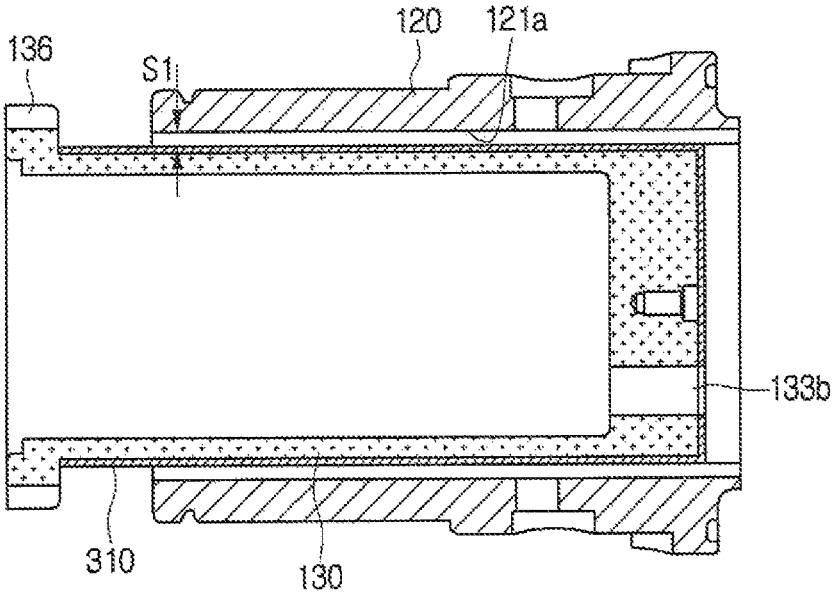
FIG. 5A is a cross-sectional view illustrating a coupled state between a cylinder and a piston when an outer surface of the piston is all surface-treated according to an embodiment.
Figure 5B:
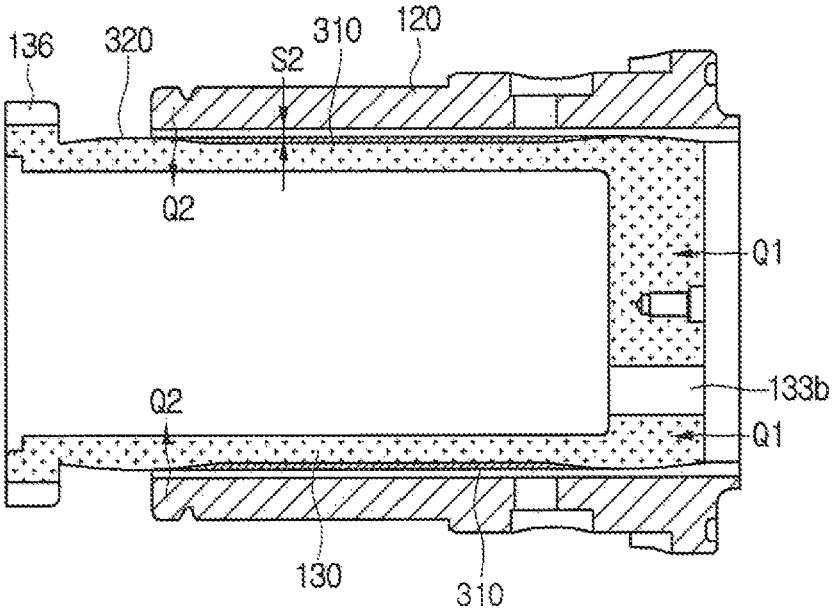
FIG. 5B is a cross-sectional view illustrating a coupled state between a cylinder and a piston when the piston has a plurality of non-surface-treated portions according to an embodiment.

FIG. 5A is a cross-sectional view illustrating a coupled state between a cylinder and a piston when an outer surface of the piston is all surface-treated according to an embodiment, and FIG. 5B is a cross-sectional view illustrating a coupled state between a cylinder and a piston when the piston has a plurality of non-surface-treated portions according to an embodiment. Unlike the previous embodiments, with this embodiment, a surface-treated portion may be formed on an entire outer surface of the piston 130. That is, the surface-treated portion may be provided to the outer circumferential surface of the piston body 131 and the outer surface of the valve support 133.

In a state in which the piston 130 is received inside the cylinder 120, the outer circumferential surface of the piston body 131 may be formed to be spaced a predetermined distance (clearance) apart from the inner circumferential surface 121 of the cylinder 120. Oil supplied from the oil supply device 160 may be introduced into the space to flow in the space via the oil supply pipe 165.

In a state in which the piston does not reciprocate, that is, in a state in which the linear compressor 10 is not operated, the inner space of the cylinder 120 may be maintained at atmospheric temperature, for example, at approximately 25° C. As the linear compressor 10 is operated, the piston 130 may reciprocate, so that compression of the refrigerant in the compression space P may occur. As the above cycles are repeated, the temperature of the inner space of the cylinder 120 rises, so that the cylinder 120 made of an aluminum material absorbs heat and is thermally expanded.

At this time, as the inner circumferential surface 121 of the cylinder 120 is provided with the non-surface-treated portion 121*a* which is not surface-treated, or the surface-treated portion, which does not have a great influence on heat transfer, the cylinder 120 may be greatly heat-expanded. As a result, the cylinder 120 may be greatly deformed in a direction in which an inner diameter of the cylinder 120 is expanded.

In the meanwhile, the surface-treated portion may be provided to the entire outer surface of the piston 130, and the surface-treated portion of the piston 130 may be made of a material hindering heat transfer. When the linear compressor 10 is operated, the piston 130 reciprocates, and although the compression of the refrigerant in the compression space P occurs and the cylinder 120 is heated, the compression heat of the compression space P or the heat of the cylinder 120 may be blocked by the surface-treated portion, so that the transfer of heat to the piston 130 may be limited. Therefore, the cylinder 120 has a relatively large heat expansion, whereas the piston 130 has a relatively small heat expansion.

Compared with the cylinder 120, as the piston 130 is formed at a relatively low temperature, heat expansion of the piston 130 may be limited. That is, the piston 130 may be less deformed in a direction in which an outer diameter thereof expands.

Finally, as the cylinder 120 and the piston 130 have different heat expansion rates due to a temperature difference between the cylinder 120 and the piston 130, an interval between the inner circumferential surface of the cylinder 120 and the outer circumferential surface of the piston 130, that is, a clearance may be relatively large (S1). When the clearance S1 is relatively large, the piston 130 is weakly supported by the cylinder 120.

In more detail, an oil film may be formed between the piston 130 and the cylinder 120 due to oil acting as a lubricating element. However, when the clearance S1 is large, a sufficient oil film may not be formed between the piston 130 and the cylinder 120, so that friction or interference may be caused, between the piston 130 and the cylinder 120. Thus, the piston 130 or the cylinder 120 may be abraded.

FIG. 5B illustrates the piston 130 and the cylinder 120 according to an embodiment. Referring to FIG. 5B, the piston 130 according to an embodiment may include a surface-treated portion 310, and non-surface-treated portions 133*a* and 320.

In more detail, non-surface-treated portion 133*a*, which is not surface-treated, may be formed on an outer surface of the valve support 133 coupled to an end of the piston body 131. The outer circumferential surface of the piston body 131 may include the surface-treated portion 310 and the non-surface-treated portion 320. The non-surface-treated portion 320 may be formed on a portion of the outer circumferential surface of the piston body 131. The non-surface-treated portion 320 may be formed to extend in the direction of the valve support 133 from the flange 136 coupled to the first end of the piston body 131.

In this regard, the non-surface-treated portion 133*a* and the non-surface-treated portion 320 may be formed at positions spaced apart from each other. In other words, the non-surface-treated portion 133*a* may be formed on the first end of the piston body 131, and the non-surface-treated portion 320 may be formed on the second end of the piston body 131.

While the piston 130 reciprocates, heat generated in the compression space P may be delivered to the cylinder 120 and the piston 130. As the inner circumferential surface 121 of the cylinder 120 is provided with the non-surface-treated portion 121*a*, which is not surface-treated or the surface-treated portion, which does not have a great influence on the heat transfer, the cylinder 120 may be greatly heat-expanded. As a result, the cylinder 120 may be greatly deformed in a direction in which the inner diameter of the cylinder 120 is expanded.

The heat may be delivered to the piston 130 through the non-surface-treated portion 133*a* of the valve support 133 or the non-surface-treated portion 320 of the outer circumferential surface of the piston body 131 (Q1, Q2). That is, the heat may be delivered to the piston 130 from both ends of the piston body 131. Therefore, as time elapses, a temperature of the piston 130 may rise to a temperature close to a temperature of the cylinder 120.

Finally, as the difference between the temperature of the cylinder 120 and the temperature of the piston 130 may be reduced, the cylinder 120 may have a similar heat expansion rate to the piston 130. That is, a degree of deformation in which the inner diameter of the cylinder 120 expands in an outer direction is similar to a degree of deformation in which the outer diameter of the piston 130 expands in an outer direction, so that a distance from the inner circumferential surface 121 of the cylinder 120 to the outer circumferential surface of the piston body 131, that is, a clearance may be relatively small (S2). Therefore, a proper amount of oil film may be formed between the cylinder 120 and the piston 130 to perform a lubrication action, thereby preventing abrasion due to friction between the cylinder 120 and the piston 130.

According to embodiments disclosed herein, a surface-treated portion may be provided to an outer surface of a piston to increase abrasion resistance, thus improving reliability of parts of a compressor.

Also, as a valve support of the piston may not be surface-treated compression heat existing in the compression space or the cylinder may be delivered to the piston, and thus, the cylinder and the piston may have similar heat expansion rates, thereby preventing a clearance between the inner circumferential surface of the cylinder and the outer circumferential surface of the piston from excessively increasing.

In addition, as the outer circumferential surface of the piston body may include a surface-treated portion and a surface-non-treated portion, and heat may be delivered from the cylinder to the piston body through the non-surface-treated portion, the cylinder and the piston may have similar heat expansion rates, thus preventing the clearance from excessively increasing.

More particularly, the valve support may be provided to or at one end of the piston body, the non-surface-treated portion may be provided to or at the other end of the piston body, and heat may be delivered to the piston body from both ends of the piston body to increase a temperature of the piston, so that the cylinder and the piston have similar temperatures. Thus, as the cylinder and the piston may have similar heat expansion rates, the clearance may be maintained within a proper range, thereby preventing abrasion due to friction of the cylinder.

Further, as the cylinder and the piston are made of a nonmagnetic material, more particularly, an aluminum material, it may be prevented that the magnetic flux generated from the motor assembly is leaked to an outside, thereby improving efficiency of the compressor. Moreover, as the permanent magnet provided to the motor assembly may be made of an inexpensive ferrite material, production costs of the compressor may be reduced.

Embodiments disclosed herein provide a linear compressor in which interference between a piston and a cylinder may be prevented.

Embodiments disclosed herein provide a linear compressor that may include a shell provided with a refrigerant inlet; a cylinder provided to an inside of the shell to form a compression space; a piston that reciprocates inside the cylinder to compress a refrigerant in the compression space; and a motor assembly that provides a drive force to the piston and provided with a permanent magnet. The piston may include a piston body having a cylindrical outer circumference and a surface-treated portion, which may be processed with a material having a set or predetermined hardness value, and a valve support unit or support that forms an end of the piston body and having a suction hole that suctions the refrigerant into the compression space. The valve support unit may form a first non-surface-treated portion, which is not surface-treated.

Embodiments disclosed herein provide a linear compressor that may include a shell provided with a refrigerant inlet; a cylinder provided to an inside of the shell to form a compression space; a piston that reciprocates inside the cylinder to compress a refrigerant in the compression space; and a motor assembly that provides a drive force to the piston and provided with a permanent magnet. The piston may include a piston body having a surface-treated portion processed with a set or predetermined material, and a second non-surface-treated portion, which is not processed, a valve support unit or support coupled to an end of the piston body and having a suction hole that suctions the refrigerant into the compression space a suction valve that selectively shields the suction hole, and a first non-surface-treated portion, which may be formed on an outer surface of the valve support unit and may be formed of a non-magnetic material, which may be not processed.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fail within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a shell provided with a refrigerant inlet;

a cylinder provided inside of the shell to form a compression space;

a piston that reciprocates inside the cylinder to compress a refrigerant in the compression space;

an oil supply device configured to pump oil in the shell, the oil supply device provided in the shell, an oil supply pipe to guide a flow of the oil from the oil supply device, the oil supply pipe extend from the oil supply device to a space between an outer circumferential surface of the piston and an inner circumferential surface of the cylinder; and a motor assembly that provides a drive force to the piston and provided with a permanent magnet, wherein the piston comprises:

a piston body having a cylindrical outer circumferential surface including a first surface-treated area comprising a material having a hardness value; and a valve support provided at a first end of the piston body and having a suction hole in communication with the compression space, the valve support having a first non-surface-treated area, wherein the inner circumferential surface of the cylinder includes a second surface-treated area, wherein the second surface-treated area is made of a material different from a material forming the first surface-treated area, wherein a hardness difference between the second surface-treated area and the first surface-treated area is not less than a predetermined hardness value, wherein the cylindrical outer circumferential surface of the piston body comprises:

a first outer circumferential surface area that forms the first surface-treated area; and a second outer circumferential surface area that forms a second non-surface-treated area, and wherein the second non-surface-treated area faces the inner circumferential surface of the cylinder, and wherein the space between the outer circumferential surface of the piston and an inner circumferential surface of the cylinder includes an oil film between the first surface-treated area of the piston body and the inner circumferential surface of the cylinder, the oil film to prevent abrasion due to friction between the piston and the cylinder.

2. The linear compressor of claim 1, wherein the valve support includes a surface that faces the compression space, and the first non-surface-treated area is formed on the surface.

3. The linear compressor of claim 1, wherein the first non-surface-treated area comprises a nonmagnetic material that delivers heat during the compression to the piston body.

4. The linear compressor of claim 1, further comprising a flange coupled to a second end of the piston body that extends in a radial direction of the piston body.

5. The linear compressor of claim 4, wherein the first outer circumferential surface area is an outer circumferential surface area that extends from the first end of the piston body toward the flange.

6. The linear compressor of claim 4, wherein the second outer circumferential surface area is an outer circumferential surface area that extends from the second end of the piston body to which the flange is coupled, toward the valve support.

7. The linear compressor of claim 1, wherein the first non-surface-treated area of the valve support is spaced from the second non-surface-treated area.

8. The linear compressor of claim 7, wherein the first non-surface-treated area is formed at the first end of the piston body, and the second non-surface-treated area is formed at a second end of the piston body.

9. The linear compressor of claim 7, wherein the second non-surface-treated area comprises a nonmagnetic material that delivers heat of the cylinder to the piston body.

10. The linear compressor of claim 1, further comprising a suction valve coupled to the valve support to selectively open the suction hole.

11. The linear compressor of claim 1, wherein the piston and the cylinder are made of a nonmagnetic material.

12. The linear compressor of claim 11, wherein the piston and the cylinder are made of aluminum or an aluminum alloy.

13. The linear compressor of claim 1, wherein the first surface-treated area of the cylindrical outer circumferential surface of the piston body is made of one of Teflon (PTFE), diamond like carbon (DLC), Nickel (Ni)-Phosphorous (P) alloy, or an anodizing layer.

14. The linear compressor of claim 13, wherein when the first surface-treated area is made of Teflon (PTFE), the hardness value of the first surface-treated area has a Vickers hardness in a range of 0-30 Hv.

15. The linear compressor of claim 13, wherein when the first surface-treated area is made of diamond like carbon (DLC), the hardness value of the first surface-treated area has a Vickers hardness in a range of 1500-1800 Hv.

16. The linear compressor of claim 13, wherein when the first surface-treated area is made of Nickel (Ni)-Phosphorous (P) alloy, the hardness value of the first surface-treated area has a Vickers hardness in a range of 500-600 Hv.

17. The linear compressor of claim 13, wherein when the first surface-treated area is made of the anodizing layer, the hardness value of the first surface-treated area has a Vickers hardness in a range of 300-500 Hv.

18. The linear compressor of claim 1, wherein the second surface-treated area of the inner circumferential surface of the cylinder is made of one of Teflon (PTFE), diamond like carbon (DLC), Nickel (Ni)-Phosphorous (P) alloy, or an anodizing layer.

* * * * *